US010422606B2

(12) United States Patent
Zournatzis

(10) Patent No.: US 10,422,606 B2
(45) Date of Patent: Sep. 24, 2019

(54) SPEARGUN WITH A SPEAR DRIVE SHAFT

(71) Applicant: Andreas Zournatzis, Drama (GR)

(72) Inventor: Andreas Zournatzis, Drama (GR)

( * ) Notice: Subject to any disclaimer, the term of this patent is extended or adjusted under 35 U.S.C. 154(b) by 0 days.

(21) Appl. No.: 14/408,298

(22) PCT Filed: Jun. 17, 2013

(86) PCT No.: PCT/GR2013/000033
§ 371 (c)(1),
(2) Date: Dec. 16, 2014

(87) PCT Pub. No.: WO2014/001825
PCT Pub. Date: Jan. 3, 2014

(65) Prior Publication Data

US 2016/0069634 A1 Mar. 10, 2016

(30) Foreign Application Priority Data

Jun. 29, 2012 (GR) ..... 120100339

(51) Int. Cl.
*F41B 7/04* (2006.01)
*F41B 11/83* (2013.01)

(52) U.S. Cl.
CPC ..... *F41B 7/04* (2013.01); *F41B 11/83* (2013.01)

(58) Field of Classification Search
CPC ..... F41B 7/04; F41B 11/83
USPC ..... 124/20.3
See application file for complete search history.

(56) References Cited

U.S. PATENT DOCUMENTS 5,243,955 A * 9/1993 Farless ..... F41B 3/005 124/20.1
7,926,474 B2 * 4/2011 Berry ..... A01K 81/06 124/20.3
9,243,864 B2 * 1/2016 Garofalo ..... F41B 11/73
2014/0251294 A1 * 9/2014 Novikov ..... F41B 7/00 124/20.1

* cited by examiner

*Primary Examiner* — Reginald Tillman, Jr.

(57) ABSTRACT

The present invention relates to a new type of speargun which uses a continuously-variable-transmission drive system for energy storage and transmission of motion of the ejection device (which may be a piston, a rubber element or a spring) to the spear. The continuously-variable-transmission drive system consists of a shaft (10), the winding drums (8-8.1-9) and the ropes (4), (11). In order to double, triple and quadruple the energy storage to the ejection device, the drive system consists of the respective number of shafts, winding drums and ropes.

11 Claims, 8 Drawing Sheets

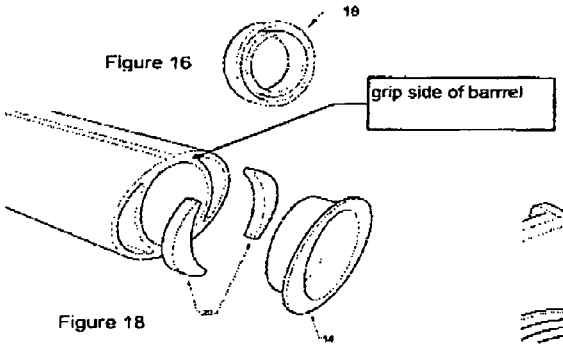
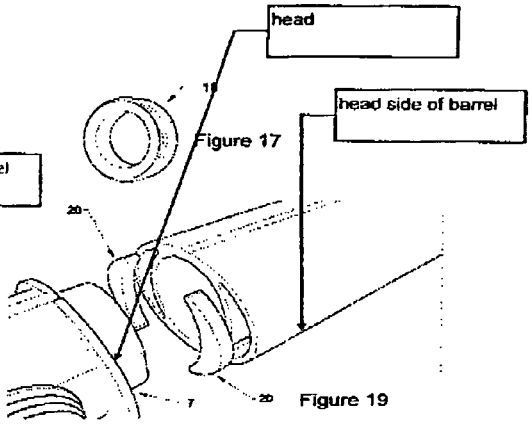
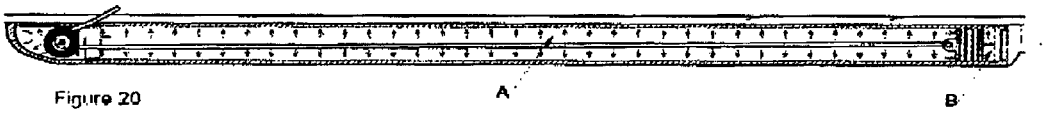
Figure 20
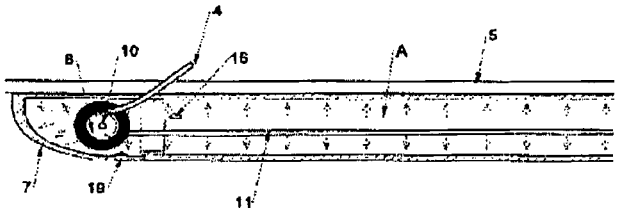
Figure 20.a
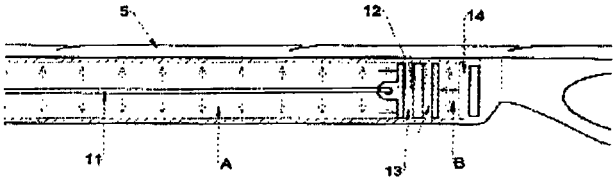
Figure 20.b
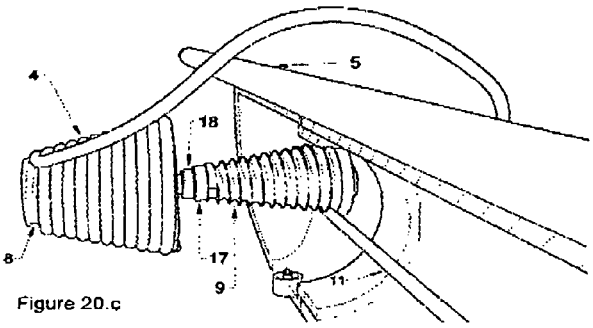
Figure 20.c

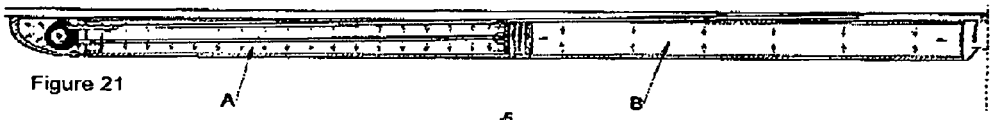
Figure 21
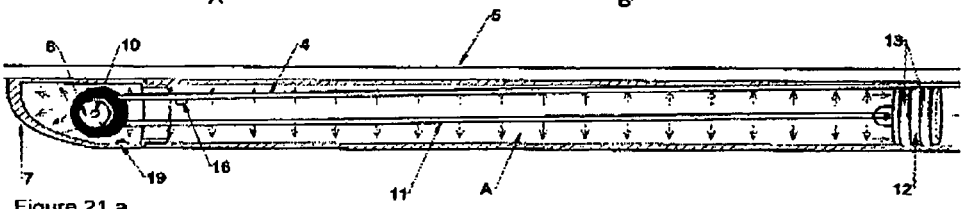
Figure 21.a
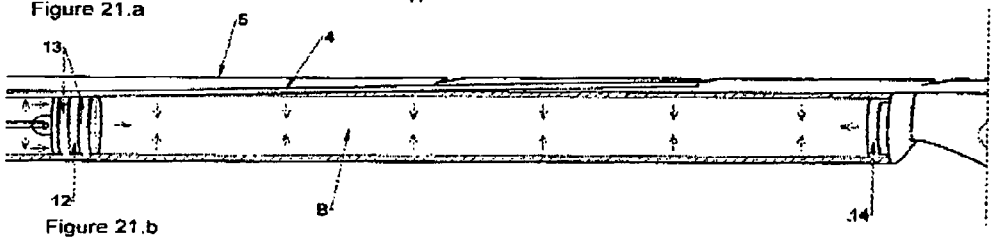
Figure 21.b
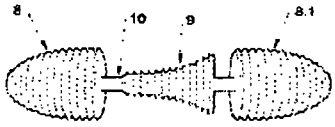
Figure 22
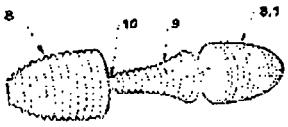
Figure 22.a
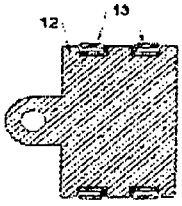
Figure 25
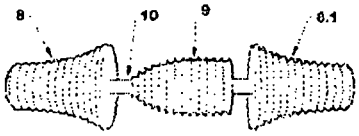
Figure 23
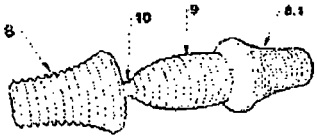
Figure 23.a
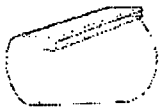
Figure 26
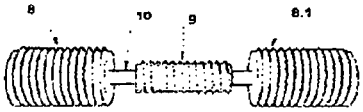
Figure 24
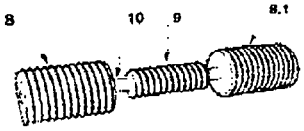
Figure 24.a

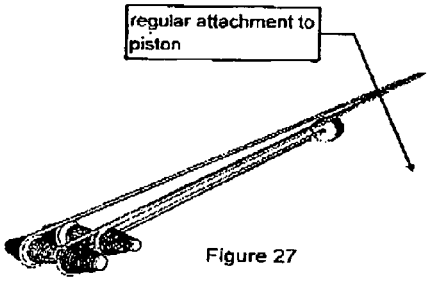
Figure 27
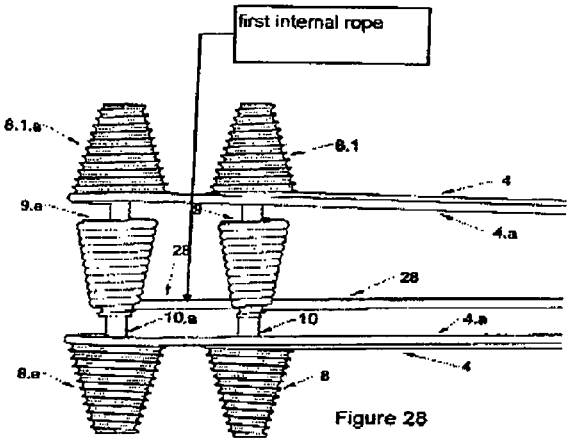
Figure 28
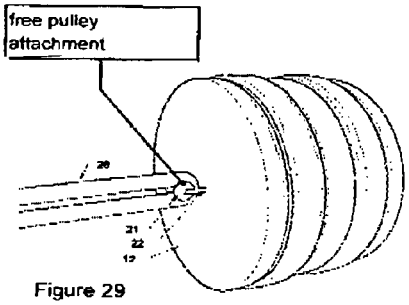
Figure 29
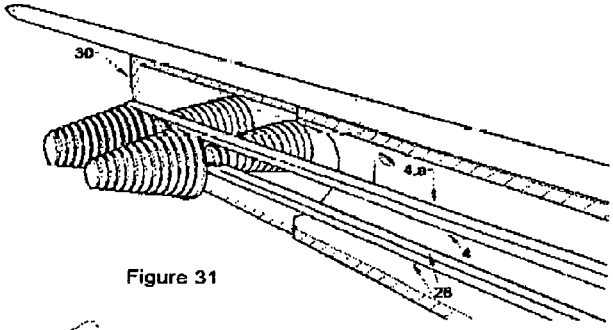
Figure 31
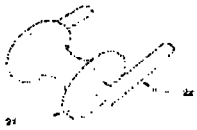
Figure 30
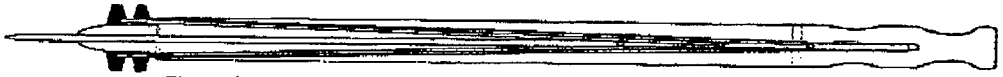
Figure 32
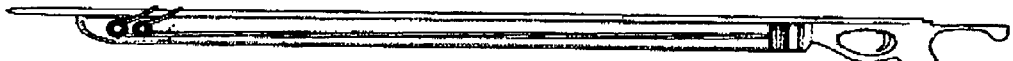
Figure 32.a
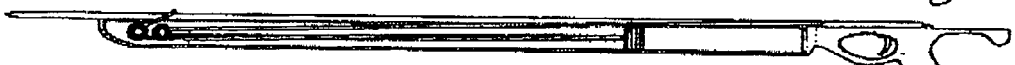
Figure 32.b
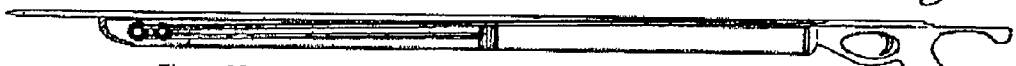
Figure 32.c

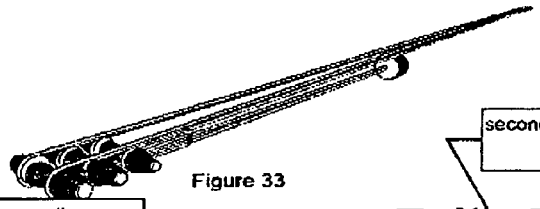
Figure 33
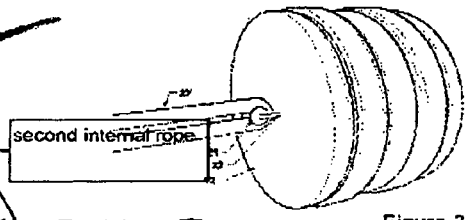
Figure 34
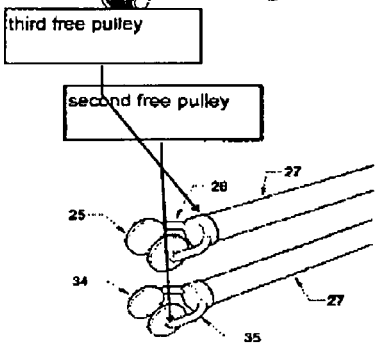
Figure 35
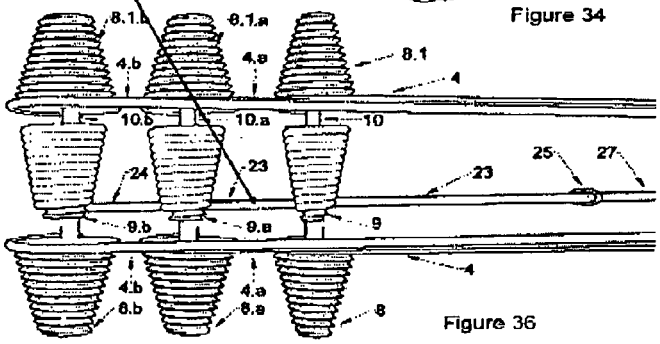
Figure 36
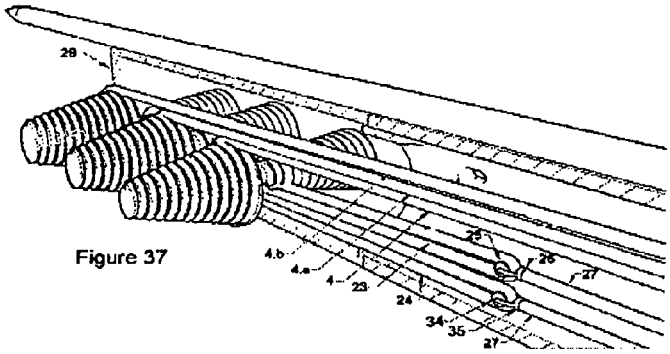
Figure 37
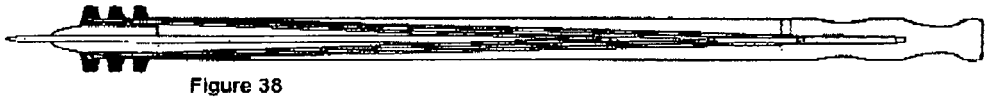
Figure 38
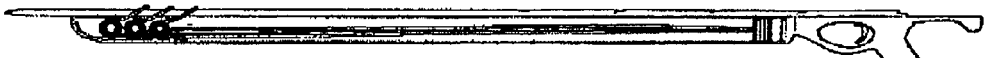
Figure 38.a
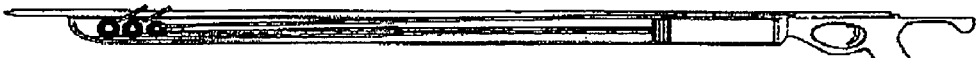
Figure 38.b

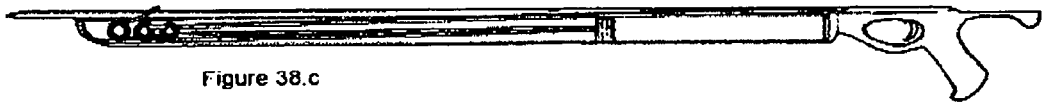
Figure 38.c
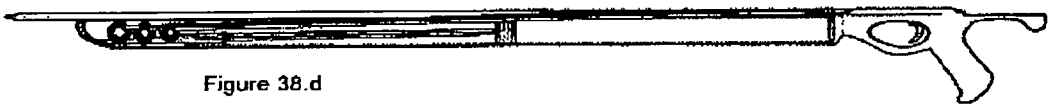
Figure 38.d
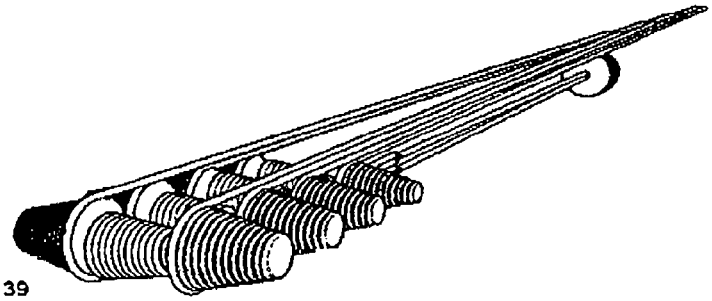
Figure 39
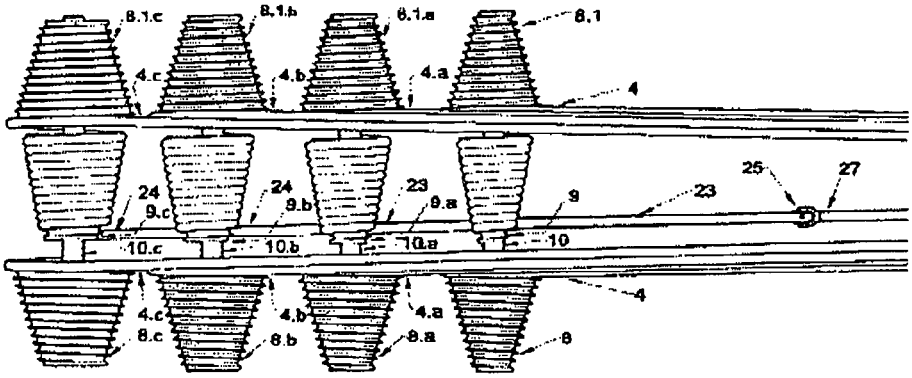
Figure 40
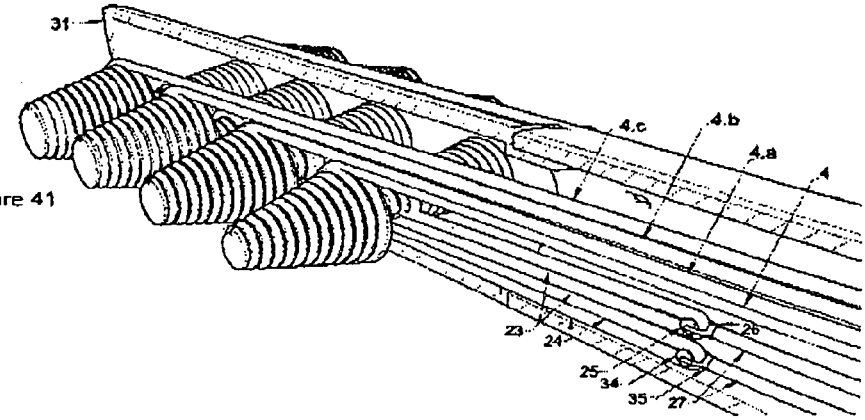
Figure 41

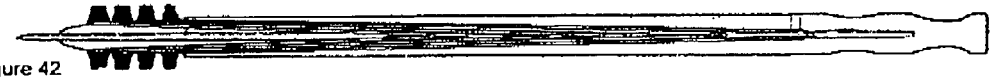
Figure 42
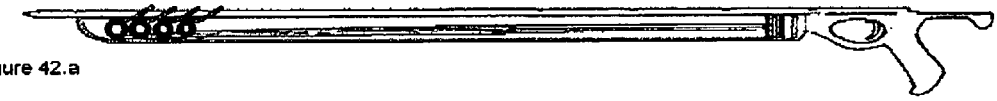
Figure 42.a
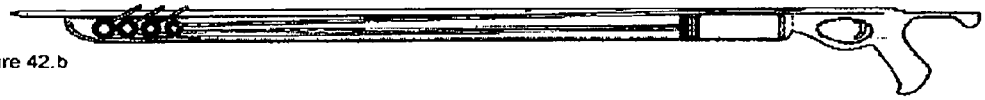
Figure 42.b
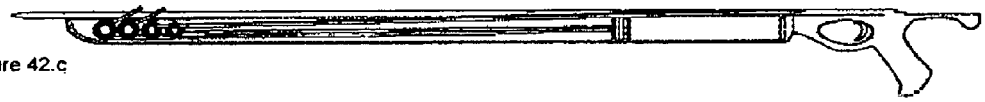
Figure 42.c
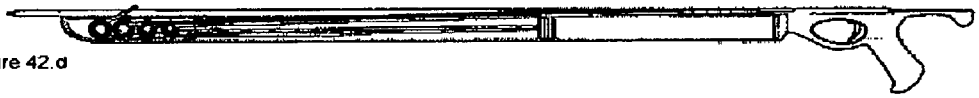
Figure 42.d
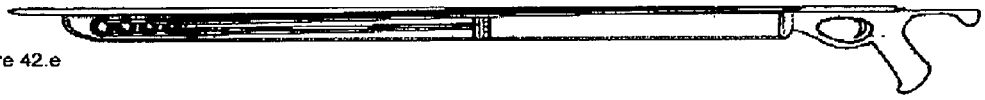
Figure 42.e
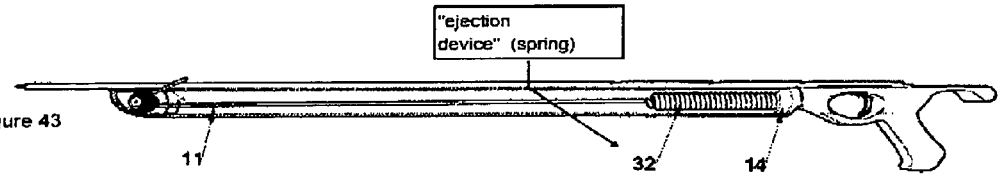
Figure 43
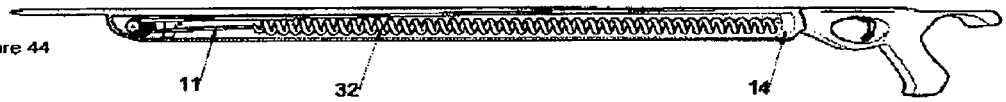
Figure 44
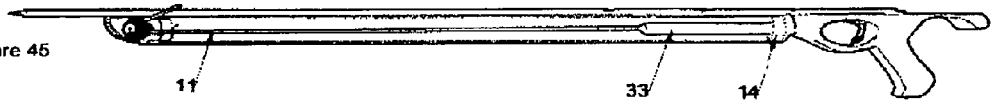
Figure 45
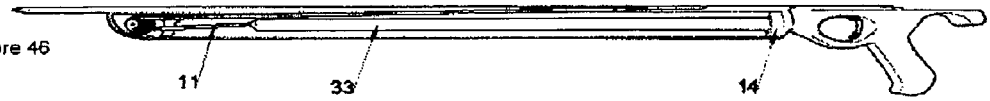
Figure 46

SPEARGUN WITH A SPEAR DRIVE SHAFT

The present invention relates to a new type of speargun which uses a spear drive and ejection shaft that constitutes a continuously-variable-transmission drive system. The ejection device of the speargun may be a piston powered by air pressure, a rubber element or a spring.

Typical previous techniques include the air-powered, rubber-powered and spring spearguns. Air-powered spearguns consist of a grip having a trigger, a barrel containing pressurized air and a barrel of smaller diameter incorporating a piston that drives a spear. Rubber-powered spearguns consists of a mechanism of a grip, a trigger, a barrel, a head, and rubber elements, which drive a spear, and spring spearguns consist of a grip including a trigger, a barrel incorporating a spring by which the spear is driven.

Disadvantages of the air-powered spearguns are that the spear is positioned in the barrel of the speargun, and aiming is difficult since the user cannot see the spear to use it as aiming line. Also, when the spear is inserted in the barrel during loading of the speargun, water also penetrates between the inner side of the barrel and the spear, so that during release the piston also supplies energy to the water that has penetrated, and thus pistons larger than 13 mm in diameter are not used and air at high pressure is necessarily introduced in the spearguns. Furthermore, due to the arrangement of the components of the speargun, force is applied only by one hand and thus loading of the air-powered speargun is difficult.

The disadvantages of the rubber-powered spearguns is the low energy that the rubber elements provide to the spear in relation to their size, as well as that the rubber elements present increased hydrodynamic resistance during firing and shifting of the speargun in the water. Disadvantage of the spring spearguns is the limited energy they provide to the spear as a result of to their construction.

Purpose of the present invention is to provide an air-powered speargun wherein the spear is arranged on the barrel, the barrel containing the compressed air and the piston is closed, and no water penetrates during loading of the speargun, pistons larger than 13 mm in diameter can be used, resulting to its operation under low air pressure, a continuously-variable-transmission drive system is arranged in the head of the speargun, which is rotated by the piston and drives the spear, while loading of the speargun is effected by both hands.

According to the invention, this is achieved by a continuously-variable-transmission drive system, which consists of the shaft (10), the winding drums (8-8.1-9), the central part of the shaft (10) with the winding drum (9) being arranged in the head (7), while its ends and the winding drums (8-8.1) are arranged outside the head. The winding drums (8-8.1) drive, by means of the rope (4), the spear (5), while they are rotated by the shaft (10) and the winding drum (9), which is connected by means of the rope (11) to the piston (12), which moves due to the pressure in the air chamber (A) and the negative pressure in the air chamber (B) during release of the speargun.

An air-powered speargun according to the present invention presents many advantages. Since the spear is arranged on the barrel, the user may use it as an aiming line. During loading, no water enters in the barrel, which results in an increase in efficiency during release. The provision of a continuously-variable-transmission drive system results in an increased loading energy, as well as to a smooth provision of acceleration to the spear. The use of a piston having a diameter larger than 13 mm allows the operation of the speargun with low air pressure. Loading of the speargun is effected by both hands and higher amounts of energy are stored. The use of ropes for the ejection of the spear result in, due to their low hydrodynamic resistance, high efficiency.

The invention is described below by means of six embodiments and with reference to the accompanying figures, in which:

FIGS. 16 and 17 show the rear and front sides of the gasket arranged on the shaft (10).

FIG. 18 shows the side of the barrels (3-15) which is arranged in the grip (2), illustrating the plugs (20) and (14) that are inserted in their holes.

FIG. 19 shows the side of the barrels (3-15) which is in the head (7), illustrating the plugs (20) and the head (7) that are inserted in their holes.

FIG. 20 shows the cross-section of the head (7) and barrels (3-15) when the speargun is unloaded. The arrows show the pressure applied by the air while the piston forms the air chambers (A) and (B).

Figure 1:
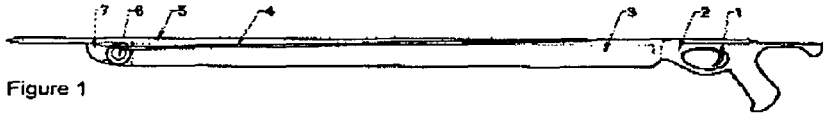
FIG. 1 shows a side view of the speargun.
Figure 2:
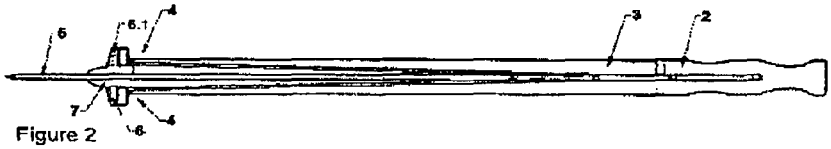
FIG. 2 shows an upper view of the speargun.
Figure 3:
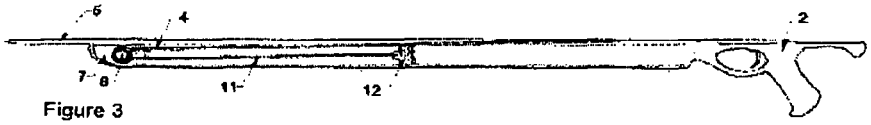
FIG. 3 shows in side view a cross-section of the barrels (3-15) and the head (7), where the piston (12) is connected to the rope (11) and this with the continuously-variable-transmission drive system which by means of the ropes (4) is connected to the spear (5) of the speargun.

FIGS. 20.A and 20.B is a magnification of the FIG. 20. The hole (16), ropes (4) and (11), the shaft (10), the winding drum (8), the valve (19), the piston (12) with its gaskets (13), the plug (14), the spear (5) are illustrated.

FIG. 20.C shows the interior of the head (7) when the speargun is unloaded. The winding drums (8), (8.1) with the rope (4) wound thereon, the gasket (18) and the ball bearing or slide ring (17), the winding drum (9) with the connecting rope (11) unwound, the spear (5) are illustrated.

FIG. 21 shows the cross-section of the head (7) and of the barrels (3-15), when the speargun is loaded. The arrows show the pressure applied by the air while the piston forms the air chambers (A) and (B).

FIGS. 21.A and 21.B is a magnification of the FIG. 21. The hole (16), the ropes (4) and (11), the shaft (10), the winding drum (8), the valve (19), the piston (12) with its gaskets (13), the plug (14), the spear (5) are illustrated.

FIGS. 22 and 22.*a* show the shaft (10) and the winding drums (8-8.1-9) where their slope generates a small variation in the speed ratio at the start of the ejection of the spear (5), while until the end of the ejection the variation in the speed ratio is increased logarithmically.

FIGS. 22 and 22.*a* show the shaft (10) and the winding drums (8-8.1-9) where their slope generates a large variation in the speed ratio at the start of the ejection of the spear (5), while until the end of the ejection the variation in the speed ratio is decreased logarithmically.

FIGS. 24 and 24.*a* show the shaft (10) and the winding drums (8-8.1-9) in which the speed ratio is invariable and their diameter is constant.

FIG. 26 shows the protective cap of the winding drum (8), while the drum (8.1) has a respective cap for the right side.

FIG. 27 shows two continuously-variable-transmission drive systems of the speargun of the second embodiment which are connected to the piston.

FIG. 28 shows the upper view of the two continuously-variable-transmission drive systems of the second embodiment. The winding drums (8-8.1-9) of the shaft (10), the winding drums (8.*a*-8.1.*a*-9.*a*) of the shaft (10.*a*) with the ropes (4), (4.*a*) and (28) are illustrated.

FIG. 29 shows the piston (12) on which a free pulley (21) has been attached with its base (22), and the rope (28).

FIG. 30 shows the free pulley (21) with its base (22).

FIG. 31 shows isometrically the cross-section of the head (30) and of the barrels (3-15) of the speargun with the two continuously-variable-transmission drive systems. The head (30), the winding drums (8-8.1-9) of the shaft (10), the winding drums (8.*a*-8.1.*a*-9.*a*) of the shaft (10.*a*) with the ropes (4), (4.*a*) and (28) are illustrated.

FIG. 32 shows the upper view of the speargun with the two continuously-variable-transmission drive systems.

FIG. 32.*a* shows the cross-section of the head (30) and of the barrels (3-15) when the speargun with the two continuously-variable-transmission drive systems is unloaded.

FIG. 32.*b* shows the cross-section of the head (30) and of the barrels (3-15) when the speargun with the two continuously-variable-transmission drive systems is loaded by the first system.

FIG. 32.*c* shows the cross-section of the head (30) and of the barrels (3-15) when the speargun with the two continuously-variable-transmission drive systems is also loaded by the second system.

FIG. 33 shows the three continuously-variable-transmission drive systems of the speargun of the third embodiment which are connected to the piston.

FIG. 34 shows the piston (12) on which a free pulley (21) has been attached with its base (22), and the rope (27). The only difference to FIG. 29 is the rope.

FIG. 35 shows the rope (27) which at both its ends has two free pulleys (25), (34) with their bases (26), (35) since it is also connected to the piston (12) through the free pulley (21).

FIG. 36 shows the upper view of the three continuously-variable-transmission drive systems of the third embodiment. The winding drums (8-8.1-9) of the shaft (10), the winding drums (8.*a*-8.1.*a*-9.*a*) of the shaft (10.*a*), the winding drums (8.*b*-8.1.*b*-9.*b*) of the shaft (10.*b*) and the free pulley (25) with the ropes (4), (4.*a*), (4.*b*), (27), (23), (24) are illustrated.

FIG. 37 shows isometrically the cross-section of the head (29) and of the barrels (3-15) of the speargun with the three continuously-variable-transmission drive systems. The head (29), the winding drums (8-8.1-9) of the shaft (10), the winding drums (8.*a*-8.1.*a*-9.*a*) of the shaft (10.*a*), the winding drums (8.*b*-8.1.*b*-9.*b*) of the shaft (10.*b*), the two free pulleys (25), (34) with their bases (26), (35) and the ropes (4), (4.*a*), (4.*b*), (27), (23), (24) are illustrated.

FIG. 38 shows the upper view of the speargun with three continuously-variable-transmission drive systems.

FIG. 38.*a* shows the cross-section of the head (29) and of the barrels (3-15) when the speargun with the three continuously-variable-transmission drive systems is unloaded.

FIG. 38.*b* shows the cross-section of the head (29) and of the barrels (3-15) when the speargun with the three continuously-variable-transmission drive systems is loaded by the first system.

FIG. 38.*c* shows the cross-section of the head (29) and of the barrels (3-15) when the speargun with the three continuously-variable-transmission drive systems is also loaded by the second system.

FIG. 38.*d* shows the cross-section of the head (29) and of the barrels (3-15) when the speargun with the three continuously-variable-transmission drive systems is also loaded by the third system.

FIG. 39 shows four continuously-variable-transmission drive systems of the fourth embodiment which are connected to the piston.

FIG. 40 shows the upper view of the four continuously-variable-transmission drive systems of the fourth embodiment. The winding drums (8-8.1-9) of the shaft (10), the winding drums (8.*a*-8.1.*a*-9.*a*) of the shaft (10.*a*), the winding drums (8.*b*-8.1.*b*-9.*b*) of the shaft (10.*b*), the winding drums (8.*c*-8.1.*c*-9.*c*) of the shaft (10.*c*) and the free pulley (25) with the ropes (4), (4.*a*), (4.*b*), (27), (23), (24) are illustrated.

FIG. 41 shows isometrically the cross-section of the head (31) and of the barrels (3-15) of the speargun with the four continuously-variable-transmission drive systems. The head (31), the winding drums (8-8.1-9) of the shaft (10), the winding drums (8.*a*-8.1.*a*-9.*a*) of the shaft (10.*a*), the winding drums (8.*b*-8.1.*b*-9.*b*) of the shaft (10.*c*), the winding drums (8.*c*-8.1.*c*-9.*c*) of the shaft (10.*c*), the two free pulleys (25), (34) with their bases (26), (35) and the ropes (4), (4.*a*), (4.*b*), (4.*c*), (27), (23), (24) are illustrated.

FIG. 42 shows the upper view of the speargun with four continuously-variable-transmission drive systems.

FIG. 42.*a* shows the cross-section of the head (31) and of the barrels (3-15) when the speargun with the four continuously-variable-transmission drive systems is unloaded.

FIG. 42.*b* shows the cross-section of the head (31) and of the barrels (3-15) when the speargun with the four continuously-variable-transmission drive systems is loaded by the first system.

FIG. 42.*c* shows the cross-section of the head (31) and of the barrels (3-15) when the speargun with the four continuously-variable-transmission drive systems is also loaded by the second system.

FIG. 42.*d* shows the cross-section of the head (31) and of the barrels (3-15) when the speargun with the four continuously-variable-transmission drive systems is also loaded by the third system.

FIG. 42.*e* shows the cross-section of the head (31) and of the barrels (3-15) when the speargun with the four continuously-variable-transmission drive systems is loaded by the fourth system.

FIG. 43 shows a speargun that stores energy by the use of a spring (32), when it is unloaded. The one end of the spring (32) is connected to the plug (14) and its other end to the rope (11).

FIG. 44 shows a speargun that stores energy by the use of a spring (32), when it is loaded. The one end of the spring (32) is connected to the plug (14) and its other end to the rope (11).

FIG. 45 shows a speargun that stores energy by the use of a rubber element (33), when it is unloaded. The one end of the rubber element (33) is connected to the plug (14) and its other end to the rope (11).

FIG. 46 shows a speargun that stores energy by the use of a rubber element (33), when it is loaded. The one end of the rubber element (33) is connected to the plug (14) and its other end to the rope (11).

Figure 12:
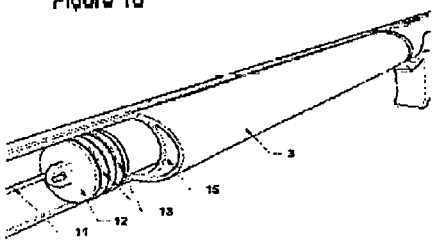
FIG. 12 shows two cross-sections of the barrels (3-15) and the piston (12) having two gaskets (13) and connected to the rope (11).
Figure 13:
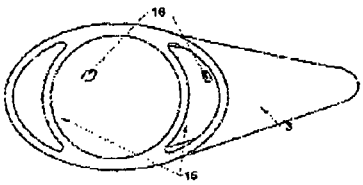
FIG. 13 shows the side of the barrels (3-15) which is arranged in the head (7), illustrating the holes (16) and how the barrels are connected on the upper and lower sides.
Figure 14:
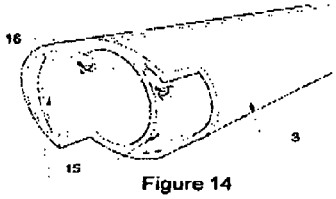
FIG. 14 shows four cross-sections of the barrels (3-15) which are arranged in the head (7), illustrating the holes (16) and how the barrels are connected on the upper and lower sides.

In the first embodiment and in the FIGS. 12, 13, 14, the outer barrel (3) of the speargun is shown which includes the inner barrel (15) to which it is connected on the upper and lower sides since they are manufactured as a single body and from the same material, which leads to a very high strength of the barrels to the forces applied thereon, simplicity and lower manufacturing cost. Purpose of the barrels is to form two different chambers, where the outer one (3) will contain pressurized air, while the inner one (15) will contain pressurized air and the piston (12) with the rope (11) which will provide rotational motion to the shaft (10) of the head, FIG. 15. The air chambers of the two barrels (3) and (15) are connected through the holes (16) so that they can exchange gases and perform pressure equation when the air volume in the barrel (15) is increased or decreased (and the pressure in the reverse manner) due to the piston (12) during loading or release of the speargun.

Figure 4:
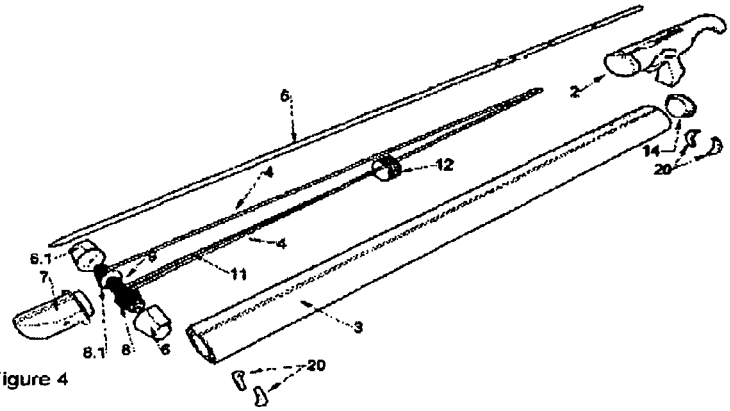
FIG. 4 shows in exploded view the majority of the components of the speargun.
Figure 5:
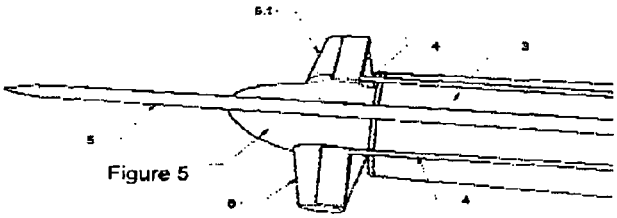
FIG. 5 shows a side upper view of the speargun, while FIG. 6 show the same with the protective caps (6) and (6.1) removed.
Figure 6:
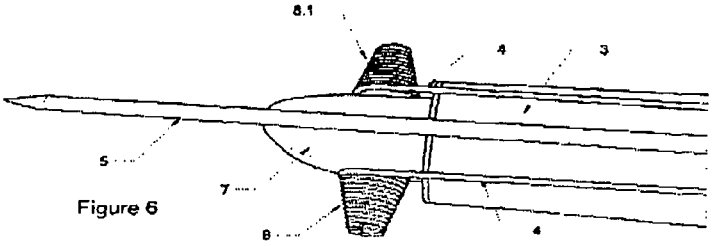

On the side of the barrels (3) and (15) where these are connected to the grip, plugs (14) and (20), FIGS. 4, 18, are mounted, which peripherally have o-rings at the points contacting the barrels, in order to prevent air leakage therefrom. The plug (14), additionally to the o-ring, joins to the barrel in a screw manner, since both parts have threads. On the other side of the barrels (3) and (15) (where holes (16) are provided)), the head (7) and plugs (20) are mounted, FIGS. 4,19, the plugs having peripherally o-rings at the points contacting the barrels, also to prevent air leakage therefrom. The head (7), additionally to the o-ring, joins to the barrel (15) in a screw manner, since both parts have threads. The head (7), when screwed on the barrel (15), forms an extension of the air chamber, FIGS. 7, 15. In this way, the barrels (3), (15) and the head (7) have been transformed into a unified air-chamber body, since the air-chambers of the barrels (3), (15) are connected through the holes (16), and the head (7) is screwed on the barrel (15).

Figure 7:
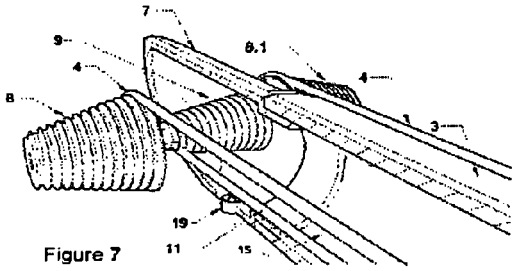
FIG. 7 shows a cross-section of the head (7) and the barrels (3-15) illustrating the continuously-variable-transmission drive system.
Figure 8:
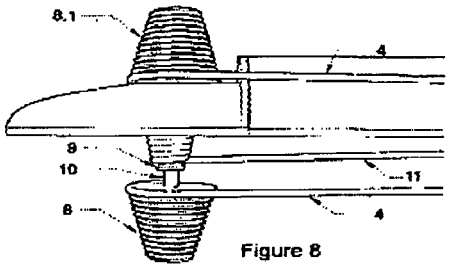
FIG. 8 shows the upper view of the FIG. 7.
Figure 15:
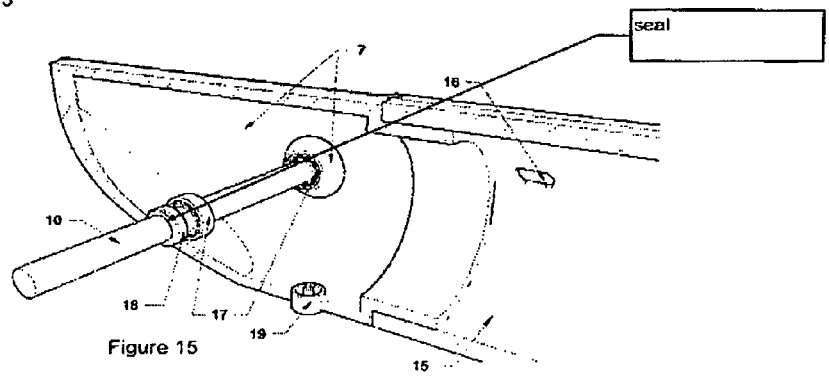
FIG. 15 shows the cross-section of the head (7) and of the barrels (3-15). The hole (16), the valve (19), the shaft (10) with the gasket (18) and the ball bearings (7) are illustrated.

Air is introduced under pressure (5-30 atmospheres) by means of an outer pump in the air chamber of the barrels (3), (15) and of the head (7) through the valve (19), which is arranged in the head (7), FIGS. 7, 15. After introduction of the air, the only way it can leak out is through the valve (19). The FIG. 20 shows the cross-section of the barrels (3), (15) and of the head (7), the arrows showing the pressure applied by the air. FIGS. 20.A and 20.B are a magnification of the FIG. 20, while FIG. 20.C shows the interior of the head (7).

When the speargun is unloaded, FIGS. 20, 20.A, 20.B and 20.C, the pressures in the air chambers (A) and (B) which are formed by the piston (12), which peripherally has two gaskets (13), are equal, and thus the piston (12) is immobile. The provision of the air-chamber (B) is expedient and operates as an air brake for the piston (12) when, during firing-release of the speargun, the piston (12) tends to reach the end of its path and to impinge on the plug (14), thus the air chamber (B) contributes in the non-stressing of the piston, plug, barrel as well as in the quiet operation of the speargun. The quantity of air in the air chamber (B) has to be so small, that it ensures that the piston (12) will not impinge on the plug (14) and it ensures as a longer travel path of the piston (12) as possible during the release of the speargun. The air in the air chamber (B) is introduced when during the assembling of the speargun the plug (14) is screwed on the barrel (15) and the piston is at a suitable small distance from the plug (14) in the barrel (15) thereafter the only way of air leakage is by removing the plug (14). The piston (12), in order to isolate the air chamber (B), has peripherally a second gasket (13) which is arranged opposite to the first one serving the air chamber (A), FIG. 25.

In order to load the speargun, force must be applied by both hands on the rope (4), FIG. 20.A, 20.C until it is brought in the incision of the spear of the speargun, FIGS. 1, 2, 3 and 21. The rope (4), as it is pulled during loading, unwinds from the winding drums (8), (8.1), applies torque on them and rotates these along with the shaft (10) and the winding drum (9), on which the rope (11) winds, pulling the piston (12) thereto, FIG. 7, 8, 11, 20.C, 21.

Figure 9:
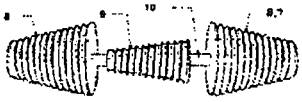
FIGS. 9 and 10 show the upper and side views of the shaft (10) and the winding drums (8-8.1-9).
Figure 10:
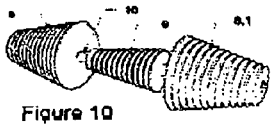
Figure 11:
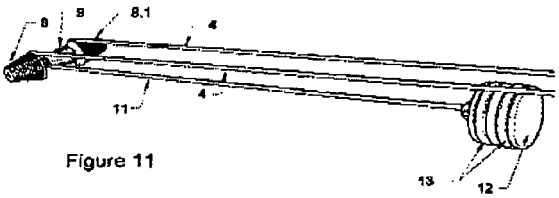
FIG. 11 shows the piston (12) which has two gaskets and is connected to the rope (11) and this is connected to the continuously-variable-transmission drive system which is connected to the rope (4).

The shaft (10) has at its both ends two winding drums (8-8.1) while at its center has the winding drum (9), FIGS. 9, 10. The winding drums (8-8.1-9) cannot rotate around the shaft (10), i.e. the system of shaft and winding drums rotates as a whole. The central part of the shaft (10) with the winding drum (9) are arranged in the head (7), i.e. in the air chamber (A), while the end parts of the shaft (10) with the winding drums (8-8.1) are arranged out of the head (7), FIGS. 6, 7, 8, 20.C. The shaft (10) has between the winding drums (8-8.1-9) two ball bearings or slide rings (17) which are fitted in the head (7), FIGS. 15, 20.C, in order to reduce the friction generated during rotation of the shaft (10), since this is not in contact with the head (7). Also, the shaft (10) has between the ball bearings or slide rings (17) and the winding drums (8-8.1) two gaskets (18), FIGS. 15, 20.C, 16, 17, which are fitted in the head (7) in order to prevent the pressurized air in the air chamber from leaking through the hole of the head (7) of the shaft (10).

When loading of the speargun is completed, FIG. 21, 21.A, 21.B and while the air chamber (A) has a higher pressure than the air chamber (A) of the FIG. 20 (in the unloaded condition), the air chamber B of FIG. 21, 21.B has a negative pressure approaching −1 Atm, thus contributing to the energy to be provided to the piston during firing-release. This occurs since the air chamber (B) of the FIG. 20, 20.B increased significantly in volume, FIG. 21, 21.B (during loading), while the small quantity of air present remained the same. The speargun can operate in this way (only by the force of the air chamber (B)), i.e. without applying air pressure thereon by an outer pump, however with limited force.

The firing-release of the speargun is effected when the user presses the trigger (1) and releases the spear (5). Then, the piston (12), due to the force that it receives from the air chambers (A) and (B), shifts towards the plug (14), applying torque on the shaft (10) and on the winding drums (8-8.1-9), by means of the connected rope (11), as this unwinds from the winding drum (9). On the winding drums (8-8.1), in turn, the rope (4) winds, which shifts and ejects the spear (5) from the speargun.

The winding drums (8-8.1-9) of the shaft (10) exhibit a varying diameter at the points where they contact peripherally the ropes (4), (11), in order to vary the radius of application of the applied forces of the ropes to the drums and of the drums to the ropes, thus they continuously vary the transmission ratio of the motion of the piston (12) to the spear (5) during release, and of the rope (4) to the piston (12) during loading. Thus, the instant displacements, speeds of the piston (12) to the spear (5) and of the rope (4) to the piston (12), as well as the torque of the winding drums (8-8.1-9) during release and loading of the speargun vary continuously.

In this way, a continuously-variable-transmission (C.V.T.) system, FIGS. 7, 8, 9, 10, 11, 20.C is obtained, which continuously applies the suitable transmission ratio (radius of application of the applied force of the winding drum (9) to the radius of application of the applied forces of the winding drums (8-8.1) and reversely) of the motion of the piston (12) to the spear (5) and of the rope (4) to the piston (12), so that the maximum energy of loading by the user and consequently the respective escape speed of the spear (5) from the speargun as well as a smooth provision of acceleration to the spear (5) during firing-release.

By a corresponding slope of the winding drums (8-8.1-9), the respective variations in the transmission ratios can be obtained, for example at the beginning of the loading the winding drums (8-8.1-9) may present a minimum torque which will continuously increase until the end of the loading, in order to equate the increasing pressure applied on the piston by the air chamber (A), where in this way the loading of the speargun may be completed by applying on the rope (4) a constant, non-variable force, or with another slope of the winding drums (8-8.1-9), the user could at first apply on the ropes (4) the maximum force which would be minimized by the end of the loading. During release, the winding drums (8-8.1-9) may present a constant torque, because while these continuously change the transmission ratio from the higher to the lower one, the pressure applied on the piston by the air chamber (A) continuously decreases. The continuously-variable-transmission drive system consists of the shaft (10), the winding drums (8-8.1-9) and the ropes (4), (11). Alternatively, the winding drums of the FIGS. 22, 22.*a*, 23, 23.*a*, 24, 24.*a* can be used. All the embodiments are mentioned in FIGS. 22, 22.*a*, 23, 23.*a*, 24, 24.*a*.

Another utility of the slope of the winding drums (8-8.1-9) is that in this way, the rope winds more effectively, and random winding, which could occur on a roller, is prevented, however the main cause for the proper winding of the rope is the spiral groove on the periphery of the winding drums (8-8.1-9), in which the ropes (4) and (11) are received. The direction of spiral groove of the winding drum (8) is the reverse to that of the winding drum (8.1).

The winding drums (8) and (8.1) are covered by the outer caps (6) and (6.1), which protect them against water and against the water resistance they would confront when rotating during firing-release of the speargun, FIGS. 2, 4, 5, 26. The void created between the outer caps (6) and the winding drums (8-8.1) is so small that the ropes (4) fit exactly therein. The winding drums of the FIGS. 22, 23, 24 also receive the respective outer caps that fit to their geometrical shape.

The maximum energy that the speargun can provide to the spear during firing-release is limited by the maximum energy the user can provide to the piston when stretching the ropes (4), which is proportional to the pressure of the air chamber (A) of the speargun. It is thus apparent that if the speargun had a second continuously-variable-transmission drive system, the user would be able to provide the piston with the double energy.

In the second embodiment, a speargun with two continuously-variable-transmission drive systems, FIG. 32, is described which can provide the spear (5) with the double energy than that of the first embodiment with one drive system.

Its components and its manner of operation are the same as those of the first embodiment. The only differences are that in this case, the head (30) that accommodates two continuously-variable-transmission drive systems is used, it has a second shaft (10.*a*) with the winding drums (8.*a*-8.1.*a*-9.*a*) and the respective gaskets, ball bearings or slide rings of the shaft, as well as a second loading rope (4.*a*). The rope (11) has been replaced by the rope (28), and as regards the piston (12) the base that connected it to the rope (11) has been replaced by the base (22) which has a free pulley (21), FIGS. 27, 28, 29, 30, 31, 32. The winding drums (8.*a*-8.1.*a*-9.*a*) are larger in diameter than the respective ones (8-8.1-9) such that the ropes (4.*a*) and (28) can pass over and under the winding drums (8-8.1) and (9).

The winding drum (9) is now connected to the rope (28), which has the unique feature to be connected to the winding drum (9.*a*) of the second shaft as well as to the piston (12) through the free pulley (21), which may rotate around the shaft of the base (22) connected to the piston (12), FIGS. 27, 28, 29, 30, 31.

By applying force on the rope (4) to load the speargun, FIG. 32.*a*, 32.*b*, 28, 29, this unwinds from the winding drums (8-8.1), thereby rotating these along with the shaft (10) and the winding drum (9) on which the rope (28) winds. The rope (28), facing at its other end resistance from the winding drum (9.*a*) as it is fully unwound and due to the free pulley (21), moves the piston (12) to half distance, consuming and respectively storing thereon the half of the energy that would be consumed and stored if no free pulley (21) were provided and the rope (28) were connected directly to the piston (12), where this would travel the double distance. Therefore, we double the pressure of the speargun and thus replenish the energy stored on the piston, apparently consuming the double energy for loading. The benefit of the use of the free pulley (21) moving the piston (12) to the half of the path, FIG. 32.*b*, is that we can apply force on the ropes (4.*a*) and load the speargun for a second time, shifting the piston from the half of its path to the end of its path, FIG. 32.*c*, finally storing on the piston the double energy than that of the speargun with one shaft. It should be noted that the user of the speargun with one shaft will fail, if he increases the pressure of the air chamber (A) too much in an attempt to increase the energy stored on the piston during loading, since there is a limit for the force that the user may apply on the ropes during loading.

During firing-release, the piston provides its energy through the free pulley (21) and the rope (28) equally to the two shafts, since these are connected by means of the ropes (4) and (4.*a*) on the same load, that is the rod (5). Since however the spear (5) has many incisions in various distances, and since the loading of the shafts to theses may be effected in any combination, during firing-release the shafts have a slightly different transmission ratio between them. The free pulley (21) in this case operates as a differential and applies torque on both shafts. Alternatively, the firing-release of the speargun may be effected by using only one of the two shafts.

In the third embodiment, a speargun with three continuously-variable-transmission drive systems, FIG. 38, is described, which can the spear (5) with the triple energy than that of the speargun with one drive system.

Its components and its manner of operation are the same as those of the second embodiment. The only differences are that in the present case, the head (29) that accommodates three continuously-variable-transmission drive systems is used, it has a third shaft (10.*b*) with the winding drums (8.*b*-8.1.*b*-9.*b*) and the respective gaskets, ball bearings or slide rings of the shaft, as well as a third loading rope (4.*b*). The rope (28) has been replaced by the rope (27) which at both its ends has two free pulleys (25), (34) since it is also connected to the piston (12) through the free pulley (21). Two further ropes (23), (24) have been provided. Regarding the rope (23), its two ends wind on the winding drums (9) and (9.*a*) while it also runs over the free pulley (25). Regarding the rope (24), its one end winds on the winding drum (9.*b*) and its other end is tied on a fixed base under the winding drum (9.*b*), while it also runs over the free pulley (34), FIGS. 33, 34, 35, 36, 37, 38. The winding drums (8.*b*-8.1.*b*-9.*b*) are larger in diameter than the respective ones (8.*a*-8.1.*a*-9.*a*) such that the ropes (4.*b*) and (24) can pass over and under the winding drums (8.*a*-8.1.*a*) and (9.*a*).

By applying force on the ropes (4) to load the speargun by means of the first shaft, FIG. 38.*a*, 38.*b*, these unwind from the winding drums (8-8.1), thereby rotating these along with the shaft (10) and the winding drum (9) on which the rope (23) winds. The rope (23), facing at its other end resistance from the winding drum (9.*a*) as it is fully unwound and due to the free pulley (25), moves the rope (27) which in turn drives the piston (12) through the free pulley (21). Since two free pulleys (25), (21) are interposed in series, the piston (12) moves to the one quarter of the distance, consuming and respectively storing thereon the one quarter of the energy that would be consumed and stored if no pulleys were provided and the rope (23) were connected directly to the piston (12), where this would travel the quadruple distance. Therefore, we quadruple the pressure of the speargun and thus replenish the energy stored on the piston, apparently consuming the quadruple energy for loading. The benefit of the use of the free pulleys (25) and (21) driving the piston (12) to the one quadruple of the path, FIG. 38.*b*, is that we can apply force on the ropes (4.*a*) and load the speargun for a second time, FIG. 38.*c*. The ropes (4.*a*) unwind from the winding drums (8.*a*-8.1.*a*) thereby rotating these along with the shaft (10.*a*) and the winding drum (9.*a*) on which the rope (23) winds. The rope (23), facing at its other end resistance from the winding drum (9) and due to the free pulley (25), moves the rope (27) which in turn drives the piston (12) through the free pulley (21) from the one quarter of its path to the two quarters, FIG. 38.*c*). Thereafter, we can apply force on the ropes (4.*b*) to load the speargun for the third time by the last shaft, FIG. 38.*c*, 38.*d*. The ropes (4.*b*) unwind from the winding drums (8.*b*-8.1.*b*) thereby rotating these along with the shaft (10.*b*) and the winding drum (9.*b*) on which the rope (24) winds. The rope (24), since its other end is tied on a fixed base under the winding drum (9.*b*) and due to the free pulley (34), moves the rope (27) which in turn drives the piston (12) through the free pulley (21) to the three quarters of its path, finally storing on the piston the triple energy than that of the speargun with one shaft. During firing-release, the piston provides its energy through the free pulleys (21), (25), (34) equally to the three continuously-variable-transmission drive systems since these are connected through the ropes (4), (4.*a*) and (4.*b*) to the same load, that is the rod (5). Since however the spear (5) has many incisions in various distances, and since the loading of the three systems in theses may be effected in any combination, during firing-release the three systems have a slightly different transmission ratio between them. The free pulleys (21), (25), (34) in this case operate as independent differentials and apply torque on the three systems. If the user does not want too much energy during firing-release of the speargun, he may alternatively use only one or two of the drive systems.

In the fourth embodiment, a speargun with four continuously-variable-transmission drive systems, FIG. 42, is described, which can provide the spear (5) with the quadruple energy than that of the speargun with one drive system.

Its components and its manner of operation are the same as those of the third embodiment. The only differences are that in the present case, the head (31) that accommodates four continuously-variable-transmission drive systems is used, it has a fourth shaft (10.*c*) with the winding drums (8.*c*-8.1.*c*-9.*c*) and the respective gaskets, ball bearings or slide rings of the shaft, as well as a fourth loading rope (4.*c*). The fixed base under the winding drum (9.*b*) holding the one end of the rope (24) has been eliminated, and this end now winds on the winding drum (9.*c*), FIGS. 39, 40, 41, 42, 34, 35. The winding drums (8.*c*-8.1.*c*-9.*c*) are larger in diameter than the respective ones (8.*b*-8.1.*b*-9.*b*) such that the ropes (4.*c*), (24) can pass over and under the winding drums (8.*b*-8.1.*b*) and (9.*b*).

By applying force on the ropes (4) to load the speargun by the first drive system, FIG. 42.*a*, 42.*b*, these unwind from the winding drums (8-8.1), thereby rotating these along with the shaft (10) and the winding drum (9) on which the rope (23) winds. The rope (23), facing at its other end resistance from the winding drum (9.*a*) and due to the free pulley (25), moves the rope (27) which in turn drives the piston (12) through the free pulley (21). Since two free pulleys (25), (21) are interposed in series, the piston (12) moves to one quarter of the distance, consuming and respectively storing thereon the one quarter of the energy that would be consumed and stored if no free pulleys were provided and the rope (23) were connected directly to the piston (12), where this would travel the quadruple distance. Therefore, we quadruple the pressure of the speargun and thus replenish the energy stored on the piston, apparently consuming the quadruple energy for loading. The benefit of the use of the free pulleys (25) and (21) driving the piston (12) to the one quarter of the path, FIG. 42.*b*, is that we can apply force on the ropes (4.*a*) and load the speargun for a second time, (42.*c*). The ropes (4.*a*) unwind from the winding drums (8.*a*-8.1.*a*) rotating these along with the shaft (10.*a*) and the winding drum (9.*a*) on which the rope (23) winds. The rope (23), facing at its other end resistance from the winding drum (9) and due to the free pulley (25), moves the rope (27) which in turn drives the piston (12) through the free pulley (21) from the one quarter of its path to the two quarters, FIG. 42.*c*. Thereafter, we can apply force on the ropes (4.*b*) to load the speargun for the third time, FIG. 38.*d*. The ropes (4.*b*) unwinds from the winding drums (8.*b*-8.1.*b*) thereby rotating these along with the shaft (10.*b*) and the winding drum (9.*b*) on which the rope (24) winds. The rope (24), facing at its other end resistance from the winding drum (9.*c*), because it is fully unwound, and due to the free pulley (34), moves the rope (27) which in turn drives the piston (12) through the free pulley (21) to the three quarters of its path. Finally, we can apply force on the ropes (4.*c*) to load the speargun for a fourth time, FIG. 42.*e*. The ropes (4.*c*) unwind from the winding drums (8.*c*-8.1.*c*) thereby rotating these along with the shaft (10.*c*) and the winding drum (9.*c*) on which the rope (24) winds. The rope (24), facing at its other end resistance from the winding drum (9.*b*) and due to the free pulley (34), moves the rope (27) which in turn drives the piston (12) through the free pulley (21) to the four quarters of its path, finally storing on the piston the quadruple energy than that of the speargun with one drive system. During firing-release, the piston provides its energy through the free pulleys (21), (25), (34) equally to the four continuously-variable-transmission drive systems since these are connected through the ropes (4), (4.*a*), (4.*b*) and (4.*c*) to the same load, that is the rod (5). Since however the spear (5) has many incisions in various distances, and since the loading of the drive systems in these may be effected in any combination, during firing-release the systems have a slightly different transmission ratio between them. The free pulleys (21), (25), (34) in this case operate as independent differentials and apply torque on the four drive systems. If the user does not want too much energy during firing-release of the speargun, he may alternatively use only one, two or three of the drive systems.

In the fifth embodiment, a speargun storing energy by the use of a spring (32), FIG. 43, 44, is described. The components and the manner of operation are the same as in the first embodiment. The only difference is that in the present case, the piston (12) has been replaced by a spring (32), the one end of which is connected to the plug (14) and its other end to the rope (11) and thus no air is introduced into the speargun. FIG. 44 shows the speargun in loaded condition and FIG. 43 in released condition.

In order to double, triple and quadruple the energy storage capacity of the speargun by the user, two, three or four continuously-variable-transmission drive systems may be used, as described in the second, third and fourth embodiments, by using all those features and components described, only replacing the piston (12) with the spring (32), which must have the double, triple or quadruple stiffness. The use of a plurality of drive systems increases additively the stored energy on the spring (32).

In the sixth embodiment, a speargun storing energy by the use of a rubber element (33), FIG. 45, 46, is described. The components and the manner of operation are the same as in the first embodiment. The only difference is that in the present case, the piston (12) has been replaced by a rubber element (33), the one end of which is connected to the plug (14) and its other end to the rope (11) and thus no air is introduced into the speargun. FIG. 46 shows the speargun in loaded condition and FIG. 45 in released condition.

In order to double, triple and quadruple the energy storage capacity of the speargun by the user, two, three or four continuously-variable-transmission drive systems can be used, as described in the second, third and fourth embodiments, and by using all these features and components described, only replacing the piston (12) with the rubber element (33), which must have the double, triple or quadruple stiffness. The use of a plurality of drive systems increases additively the stored energy on the rubber element (33).

The invention claimed is:

1. A spear gun comprising, a first barrel enclosing an ejection member, at least one second barrel which is located adjacent to said first barrel, a head member mounted to at least one of said first and said second barrel at an end, a grip which includes a triggering mechanism mounted near the other of said end opposing said head member, at least one rotatable shaft member which passes through said head member; wherein, a first pair of external winding drums are attached to both ends of said rotatable shaft member, said external winding drums located external to both said head member and said first and said second barrels; wherein, a first external rope is wound around each of said first pair of external winding drums, said first external rope forming a first loop between each of said external winding drums, said loop providing attachment to a spear shaft; wherein, said rotatable shaft member is provided with an internal winding drum located in an internal portion of said head member, and, which is affixed substantially central to said rotatable shaft member; wherein, a first internal rope is wound between said internal winding drum and said ejection member, when the at least one rotatable shaft members is employed; wherein, application of force on said first loop of said first external rope, to load said spear shaft into said spear gun, serves to unwind said first external rope from said first pair of external winding drums; and, which also serves to simultaneously wind said first internal rope, advancing said ejection member along said inner barrel to a loaded position; and, wherein, said triggering mechanism is capable of releasing said spear, when, upon firing; said first external rope winds on each of said external winding drums and simultaneously unwinds on said internal winding drum.

2. The spear gun of claim 1, comprising two rotatable shaft members which pass through said head member; wherein, a second pair external winding drums are attached to both ends of a second rotatable shaft member, said second pair of external winding drums which are located external to both said head member and said first and said second barrels; wherein, a second external rope is wound around each of said second pair of external winding drums, said external rope forming a second loop between each of said second pair of external winding drums, said second loop providing an auxiliary attachment to a spear; wherein, said second rotatable shaft members are further provided with a second internal winding drum located in an internal portion of said head member, and, which is affixed substantially central to said rotatable shaft and in alignment with said ejection member located with said first barrel; wherein, said first internal rope is wound through at least one free pulley attached to said ejection member, and then, around said second internal winding drum; and wherein, the diameter of said second set of external winding drums and said second internal winding drum are sized to provide rope clearance between said first and said second pair of external winding drums, and also between, said first and said second pair of internal winding drums; and wherein, during loading of the spear shaft into said spear gun, the path of said ejection member along said inner barrel is reduced compared to when a single rotatable shaft is employed.

3. The spear gun of claim 1, comprising three rotatable shaft members which pass though said head member; wherein, a second pair external winding drums are attached to both ends of a second rotatable shaft member, said second pair of external winding drums which are located external to both said head member and said first and said second barrels; wherein, a second external rope is wound around each of said second pair of external winding drums, said external rope forming a second loop between each of said second pair of external winding drums, said second loop providing an auxiliary attachment to a spear; wherein, said second rotatable shaft members are further provided with a second internal winding drum located in an internal portion of said head member; and, which is affixed substantially central to said second rotatable shaft and in alignment with said ejection member located with said first barrel; wherein, a third pair external winding drums are attached to both ends of a third rotatable shaft member, said third pair of external winding drums which are located external to both said head member and said first and said second barrels; wherein, a third external rope is wound around each of said third pair of external winding drums, said external rope forming a third loop between each of said third pair of external winding drums, said third loop providing an auxiliary attachment to a spear; wherein, said third rotatable shaft member is further provided with a third internal winding drum located In an internal portion of said head member, and, which is affixed substantially central to said third rotatable shaft and in alignment with said ejection member located with said first barrel; wherein, an auxiliary rope is passed through said free pulley attached to said ejection member, whereby said auxiliary rope is terminated with a second and third free pulley; wherein, said first internal rope is attached to said first internal drum and winds around one of said second or said third free pulleys and is then anchored to said head; wherein, said second internal rope, is attached to said second internal drum and winds around the other of said second or said third free pulleys, and is then attached to said third internal drum; wherein, the diameter of said second set of external winding drums and said second internal winding drum are sized to provide rope clearance between each pair of external winding drums, and also between, each pair of internal winding drums; and wherein, during loading of the spear shaft into said spear gun, the path of said ejection member along said inner barrel is reduced in proportion to the total number of rotatable shaft members employed.

4. The spear gun of claim 3 comprising additional rotatable shaft members which pass though said head member wherein;

each of said additional rotatable shaft members are provided with an additional pair of external winding drums and additional internal winding drum located within said head; wherein, an additional external rope is wound around each of said additional pair of external winding drums, said additional external rope forming an additional loop between each of said additional pair of external winding drums, said additional loop providing an additional auxiliary attachment to a spear; wherein, an additional internal rope is further wound around said additional internal winding drum and is routed through one of said second or said third free pulley on one of said ends of said auxiliary rope.

5. The spear gun of claim 1; wherein, said internal and external winding drums have a varying diameter at the points where they contact respective internal and external ropes; wherein, a continuously variable transmission capability is provided which continuously changes the torque required to load a spear, and also, to continually change the speed of said spear during its release.

6. The spear gun of claim 1; wherein, said internal and external winding drums, have spiral grooves on their periphery to receive said internal and said external ropes; wherein, said external winding drums are optionally surrounded by outer caps.

7. A spear gun with a spear drive shaft according to claim 1, characterized in that said ejection member is a piston which during release of the spear gun is driven by the air pressure within a unified air chamber created in the open space between said ejection member, said second barrel and said head member; wherein, said first and said second barrels are connected through holes provided near the end of said first and said second barrels where said head is mounted; wherein, said first and second barrels are both sealed at the end near of said grip, and, said second barrel is sealed at end near said head, preferably with plugs; wherein, said head is sealed at least, to said first barrel, preferably with a gasket; wherein, the inside of said head is open to said first barrel; whereby, said head member retains air pressure from first barrel by a pair of seals, preferably, in conjunction with bearings provided between said rotatable shaft member and said head member.

8. The spear gun with a spear drive shaft according to claim 7, characterized in that the space within said first barrel, between said piston, and sealed grip end of said first barrel, is provided with a quantity of air which assists the stopping of said spear after firing.

9. The spear gun with a spear drive shaft according to claim 1; wherein, said ejection member is a spring.

10. The spear gun with a spear drive shaft according to claim 1; wherein, said ejection member is a rubber element.

11. The spear gun of claim 1; wherein, a pair of seals, preferably in conjunction with bearings, are provided between at least one of said rotatable shaft member and said head member.

* * * * *